US005765627A

United States Patent [19]

Joas

[11] Patent Number: 5,765,627

[45] Date of Patent: Jun. 16, 1998

[54] COOLING AIR SYSTEM

[75] Inventor: Karl-Oskar Joas, Heidenheim, Germany

[73] Assignee: Voith Turbo GmbH & Co. KG, Germany

[21] Appl. No.: 752,215

[22] Filed: Nov. 19, 1996

[30] Foreign Application Priority Data

Nov. 24, 1995 [DE] Germany ..... 195 43 902.3

[51] Int. Cl.[6] ..... F28F 27/02

[52] U.S. Cl. ..... 165/103; 165/119; 165/DIG. 110

[58] Field of Search ..... 165/119, 103, 165/DIG. 110

[56] References Cited

U.S. PATENT DOCUMENTS

| | | | |
|---|---|---|---|
| 3,693,328 | 9/1972 | Paucha . | |
| 4,542,785 | 9/1985 | Bagnall et al. | 165/119 X |
| 4,934,449 | 6/1990 | Watt et al. | 165/119 X |
| 5,050,487 | 9/1991 | Arold et al. | 165/119 X |
| 5,060,717 | 10/1991 | Morita et al. | 165/119 X |
| 5,085,266 | 2/1992 | Arold et al. | 165/119 X |
| 5,092,396 | 3/1992 | Murano et al. | 165/119 |

FOREIGN PATENT DOCUMENTS

| | | | |
|---|---|---|---|
| 1 095 701 | 6/1955 | France . | |
| 2 703 967 A1 | 10/1994 | France . | |
| 3416810 | 11/1985 | Germany | 165/119 |
| 0134137 | 5/1989 | Japan | 165/119 |
| 700326 | 6/1951 | Sweden . | |
| 1425464 | 2/1976 | United Kingdom | 165/119 |

OTHER PUBLICATIONS

Farr Self–Cleaning Inertial Air Cleaner; Bulletin B–1800–14B.

*Primary Examiner*—Ira S. Lazarus
*Assistant Examiner*—Christopher Atkinson
*Attorney, Agent, or Firm*—Randall J. Knuth

[57] ABSTRACT

The invention concerns a cooling air system for motorized vehicles, notably rail vehicles with diesel engines. The system includes a filter operating in a suction fashion and splitting the air being filtered in a clean-air flow and a dusty-air flow. A radiator follows the filter with a fan evacuating air through the radiator. A bypass line is provided which circumvents the radiator and acts on the dusty-air bushing of the filter with a vacuum of the fan or fans.

4 Claims, 2 Drawing Sheets

COOLING AIR SYSTEM

BACKGROUND OF THE INVENTION

1. Field of the Invention

The invention concerns a cooling air system, notably for motorized vehicles, particularly rail vehicles.

2. Description of the Related Art

On rail vehicles powered by internal combustion engines, cooling air systems occupy considerable space and have a correspondingly large weight. This is true particularly for the filter system that must precede the radiator so as to supply it with clean air. Usable filters, for example, are filter systems by Farr Company, as shown in their company bulletin no. B-1800-14B, the filter marketed under the trade name DYNAVANE. These filter systems are based on the principle of subjecting the air being cleaned to frequent reversals, thereby effecting a splitting between a clean-air flow and a dusty-air flow. The dusty-air flow proceeds to a dusty-air duct, from whence it must be removed. A separate suction fan is required for that purpose.

One objective underlying the invention is to design a cooling air system in such a way that its space needs and its weight are below that of conventional cooling air systems.

SUMMARY OF THE INVENTION

The invention includes a fan, which is indispensable in a cooling air system, that also can be utilized for removing the dusty air of the filter. The invention provides a bypass line between the dusty-air bushing, or dusty-air duct, of the filter and the fan. Therefore, clean air flows through the radiator while the dusty air proceeds through the bypass duct and through the fan of the system. This makes a separate dusty-air fan dispensable, thereby saving space and weight. Thus, the system can be made smaller and more lightweight than previous systems.

Stat another advantage of the present invention in that since the dusty air proceeds through the fan of the cooling air system, this fan is much larger, and thus is less sensitive than the dusty-air fans previously used. Therefore, when using the invention, no problems are encountered in the main fan by the dusty air passing through it.

BRIEF DESCRIPTION OF THE DRAWINGS

The invention is more fully explained with the aid of the drawings.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 3:
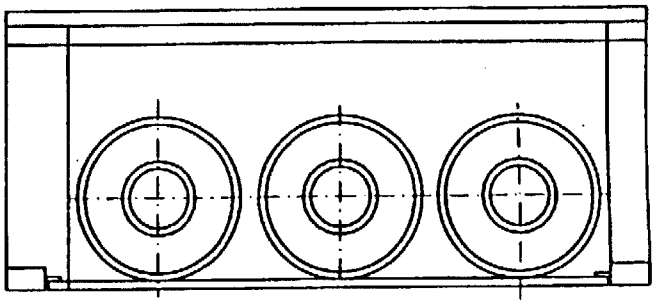
FIG. 3 shows a side elevation view of the cooling air system.
Figure 2:
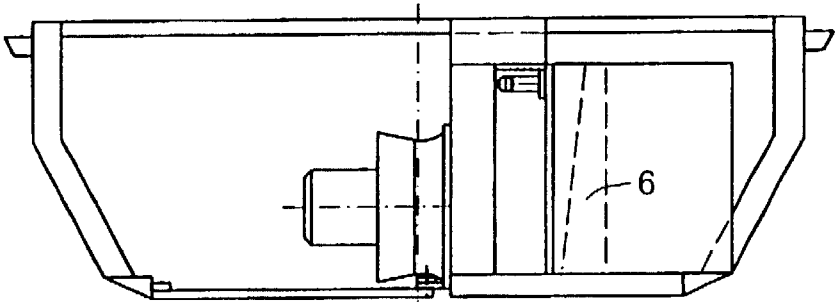
FIG. 2 shows a front view of the cooling air system.
Figure 1:
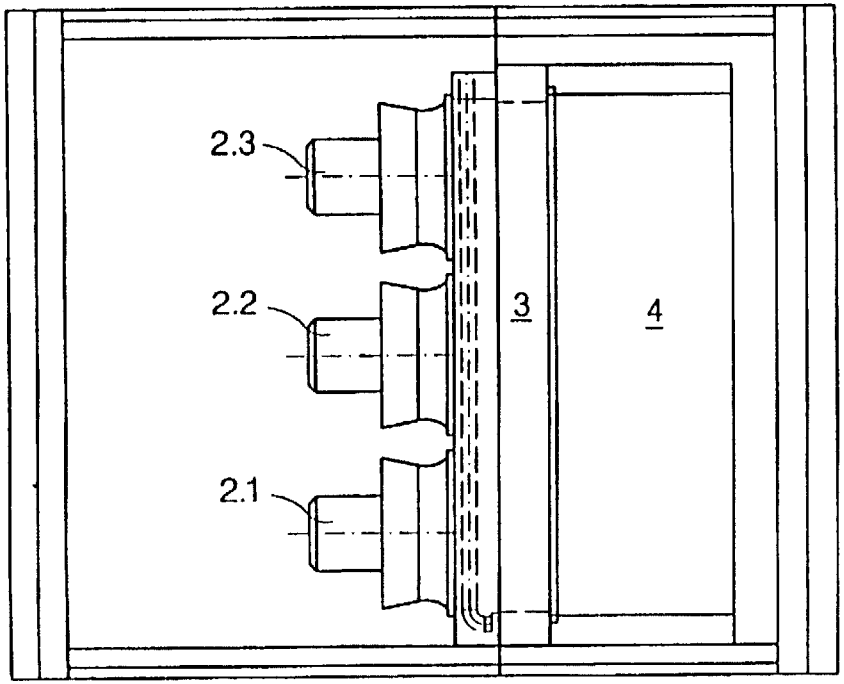
FIG. 1 shows an underfloor cooling air system in plain view.

The system is disposed above the rails—refer to rail top edge 1. It comprises three fans 2.1, 2.2., 2.3, a radiator 3 and a filter 4. A cooling air flow 5 is sucked in due to the suction force of the fans 2.1, 2.2, and 2.3. That flow proceeds first through filter 4, in which it splits in a clean-air flow and a dusty-air flow. The clean-air flow proceeds to the radiator 3 and on to the fans 2.1, 2.2, and 2.3. The dusty-air flow proceeds through a bypass duct 6 extending around the radiator 3 and to the fans 2.1, 2.2, and 2.3. It should be understood that the fans must be configured for the two airflows, that is, for the clean-air flow and the dusty-air flow.

As can be seen, the direction of travel 7 is perpendicular to the cooling-air flow 5.

Figure 4:
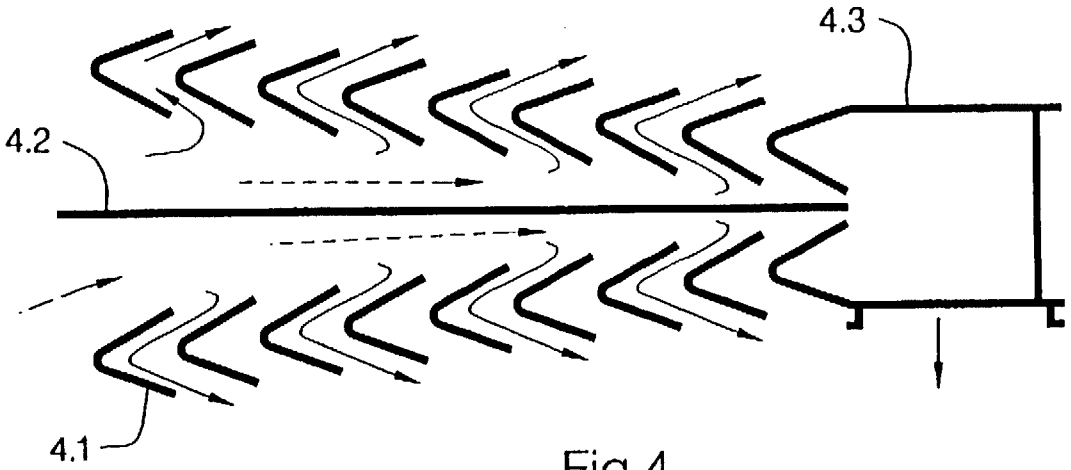
FIG. 4 shows a schematic representation of the cooling sytem filter.

FIG. 4 shows, schematically, the structure of the filter 4. The filter 4 comprises a plurality of deflectors 4.1, a partition plate 4.2 and a collection duct 4.3 for dusty air. The deflectors 4.1 form angled ducts with one another, through which the clean air issues. As mentioned above, the dusty-air duct 4.3 connects via the bypass line 6 to the three fans.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A cooling air system for motorized vehicles comprising;

a filter that operates under suction pressure and splitting air being filtered into a clean-air flow and separate a dusty-air flow, said filter including a dusty-air duct;

a radiator downstream from said filter;

a fan creating a vacuum for sucking air through the radiator; and a bypass line is provided which, circumventing the radiator, acts with a vacuum of said fan on the dusty-air duct of the filter.

2. The cooling air system of claim 1, which includes a plurality of fans.

3. The cooling air system of claim 1, in which said bypass line surrounds the radiator.

4. The cooling air system of claim 1 in which said filter is a gravitational-force filter.

* * * * *